US006554077B2

(12) United States Patent
Polan

(10) Patent No.: US 6,554,077 B2
(45) Date of Patent: Apr. 29, 2003

(54) QUICK RESPONSE ADJUSTABLE AUTOMATIC SPRINKLER ARRANGEMENTS

(75) Inventor: George S. Polan, Perkiomenville, PA (US)

(73) Assignee: The Reliable Automatic Sprinkler Co., Inc., Mount Vernon, NY (US)

( * ) Notice: Subject to any disclaimer, the term of this patent is extended or adjusted under 35 U.S.C. 154(b) by 0 days.

(21) Appl. No.: 09/833,905

(22) Filed: Apr. 12, 2001

(65) Prior Publication Data

US 2002/0148620 A1 Oct. 17, 2002

(51) Int. Cl.[7] ..... A62C 37/12
(52) U.S. Cl. ..... 169/57; 169/19; 169/37
(58) Field of Search ..... 169/19, 37, 38, 169/39, 42, 54, 57

(56) References Cited

U.S. PATENT DOCUMENTS

| | | | |
|---|---|---|---|
| 3,459,266 | A | 8/1969 | Ault |
| 3,714,989 | A | 2/1973 | Gloeckler |
| 4,491,182 | A | 1/1985 | Pieczykolan |
| 4,648,459 | A | 3/1987 | Pieczykolan |
| 4,657,085 | A | 4/1987 | Jacobsen |
| 4,739,835 | A | 4/1988 | Polan et al. |
| 4,766,961 | A | 8/1988 | Macie |
| 4,785,888 | A | 11/1988 | Blum et al. |
| 4,977,963 | A | 12/1990 | Simons |
| 5,036,923 | A | 8/1991 | Shea, Sr. |
| 5,094,298 | A | 3/1992 | Polan |
| 5,497,834 | A | 3/1996 | Onuki |
| 5,513,708 | A | 5/1996 | Sundholm |
| 5,579,846 | A | 12/1996 | Meyer et al. |
| 5,609,211 | A | 3/1997 | Meyer et al. |
| 5,664,630 | A | 9/1997 | Meyer et al. |
| 5,667,017 | A | 9/1997 | Hoffman et al. |
| 5,669,449 | A | 9/1997 | Polan et al. |
| 5,732,778 | A | 3/1998 | Tateno |
| 5,865,256 | A | 2/1999 | Pounder |
| 5,924,492 | A | 7/1999 | Kikuchi et al. |
| 5,944,113 | A | 8/1999 | Sundholm |
| 5,967,237 | A | 10/1999 | Sundholm |
| 6,082,465 | A | 7/2000 | Retzloff |
| 6,152,236 | A | 11/2000 | Retzloff et al. |
| 6,367,559 | B1 | 4/2002 | Winebrenner |

*Primary Examiner*—Lisa A. Douglas
(74) *Attorney, Agent, or Firm*—Baker Botts LLP

(57) ABSTRACT

The sprinkler arrangements described in the specification include a sprinkler body with an axial passage and an axially movable assembly movable between a sealing position and an open position and including a Belleville washer engageable with a shoulder in the sprinkler body to seal the axial passage in the sealing position and a deflector to distribute water emerging from the passage when the movable assembly is in the open position. A locking assembly which is separable from the sprinkler body normally retains the axially movable assembly in the sealing position and is releasable by a temperature sensitive apparatus at an elevated temperature to permit the movable assembly to move to the open position. In one embodiment the axially movable member has a central post which is slidably guided by a tripod at the outer end of the axial passage. The temperature sensitive apparatus includes a locking disc supported by a temperature responsive element which may be a glass bulb supported in a bulb cage, a plug of fusible material supporting a locking pin, or a solder link retaining the ends of lever members to hold the locking disc in place.

26 Claims, 10 Drawing Sheets

QUICK RESPONSE ADJUSTABLE AUTOMATIC SPRINKLER ARRANGEMENTS

BACKGROUND OF THE INVENTION

This invention relates to fire extinguishing sprinklers and, more particularly, to new and improved sprinkler arrangements having a compact structure and adapted to respond quickly to elevated temperature conditions indicative of a fire.

Sprinkler systems are widely used for automatic fire protection in residential, commercial and public buildings. Heretofore, many sprinklers have been made with a frame structure incorporating a temperature responsive element located within the frame structure. In order to expose the temperature responsive element to ambient conditions such sprinklers must be mounted so that the entire frame structure including a deflector affixed at its outer end projects downwardly from the ceiling, providing an unattractive appearance. Some conventional sprinklers have a slidable valve and deflector arrangement which is normally retained in a retracted condition by a complex captive locking mechanism that, upon activation, moves with the valve from the retracted close position to an open position. Typical sprinklers of this type are disclosed in U.S. Pat. Nos. 4,491,182, 5,036,923, and 5,094,298.

In other types of quick response sprinklers, such as shown in U.S. Pat. Nos. 4,766,961, 4,785,888 and 6,152,236, the locking mechanism is ejected from the sprinkler when the deflector is moved from the closed position to the open position. Most of the prior art sprinklers of that type include a deflector supported from pins which are slidably supported in lateral extensions of the sprinkler body so that they are normally disposed in the region surrounding the portion of the body containing the passage for water. Such arrangements not only enlarge the size of the sprinkler but also require complex slidable supporting structures for the deflector. U.S. Pat. No. 6,152,236 discloses a sprinkler having a temperature responsive element having the same diameter as the deflector so as to conceal the deflector.

In many sprinklers, a glass bulb is provided as a thermally responsive device to activate the sprinkler at elevated temperatures. Such glass bulbs must be adequately exposed to the surrounding atmosphere to assure a fast response to hot gases but, at the same time, must be adequately protected against accidental or malicious breakage. U.S. Pat. Nos. 5,944,113 and 5,967,237 disclose sprinklers having a glass bulb temperature responsive element which is enclosed in a cage projecting from the outer end of the sprinkler.

SUMMARY OF THE INVENTION

Accordingly, it is an object of the present invention to provide a quick response adjustable automatic sprinkler which overcomes disadvantages to the prior art.

Another object of the invention is to provide a quick response sprinkler having a simple and compact configuration.

A further object of the invention is to provide an enclosure for a glass bulb-type temperature sensitive element for a sprinkler which protects the bulb while assuring access to the bulb by high temperature gases.

In accordance with one aspect of the invention a quick response sprinkler arrangement includes a sprinkler body having an axial passage and a deflector supported on a central post which is slidably guided parallel to the axis of the sprinkler passage by a tripod member supported at the outlet end of the passage and having a central opening in which the post is slidable. A tapered neck at the inner end of the post supports a spring washer which engages a shoulder in the passage of the sprinkler body to seal the passage as long as the post and the deflector are retained in an inward position by a locking arrangement. In one form of locking arrangement a plurality of balls are retained by a locking disc so that they engage a peripheral groove in an inner surface of a portion of the sprinkler body, the locking disc being held in position by a thermally responsive element, such as a fusible plug or a glass bulb.

In one embodiment, a plug of fusible material in a tubular housing supports the locking disc in position and heat is transmitted to the fusible material by a heat collecting structure attached to the tubular housing including a thin metal cup member which opens in the direction facing away from the sprinkler passage and a thin metal dish member open inwardly toward the sprinkler passage and having inclined sides with radially projecting cut outs. In another embodiment the thermally responsive element is a glass bulb which is mounted in a cage having a plurality of longitudinal openings which extend parallel to the sprinkler axis and have concave sides shaped to direct gases inwardly from the periphery of the cage toward the bulb mounted in the cage. In a further embodiment the sprinkler arrangement includes a locking disc covering the sprinkler deflector and having a diametrical channel in its outer surface along with lever members received in the channel each having an inner end engaging a peripheral groove in an inner surface of the sprinkler body and an outer end received in a flat horizontally disposed temperature sensitive solder link element so as to retain the locking disc in locking position until they are released by fusing of the solder in the temperature sensitive element. The locking disc also has a peripheral bevel to direct hot gases toward the upper surface of the temperature sensitive level.

BRIEF DESCRIPTION OF THE DRAWINGS

Further objects and advantages of the invention will be apparent from the reading of the following description in conjunction with the accompanying drawings, in which.

DETAILED DESCRIPTION OF PREFERRED EMBODIMENTS

Figure 1:
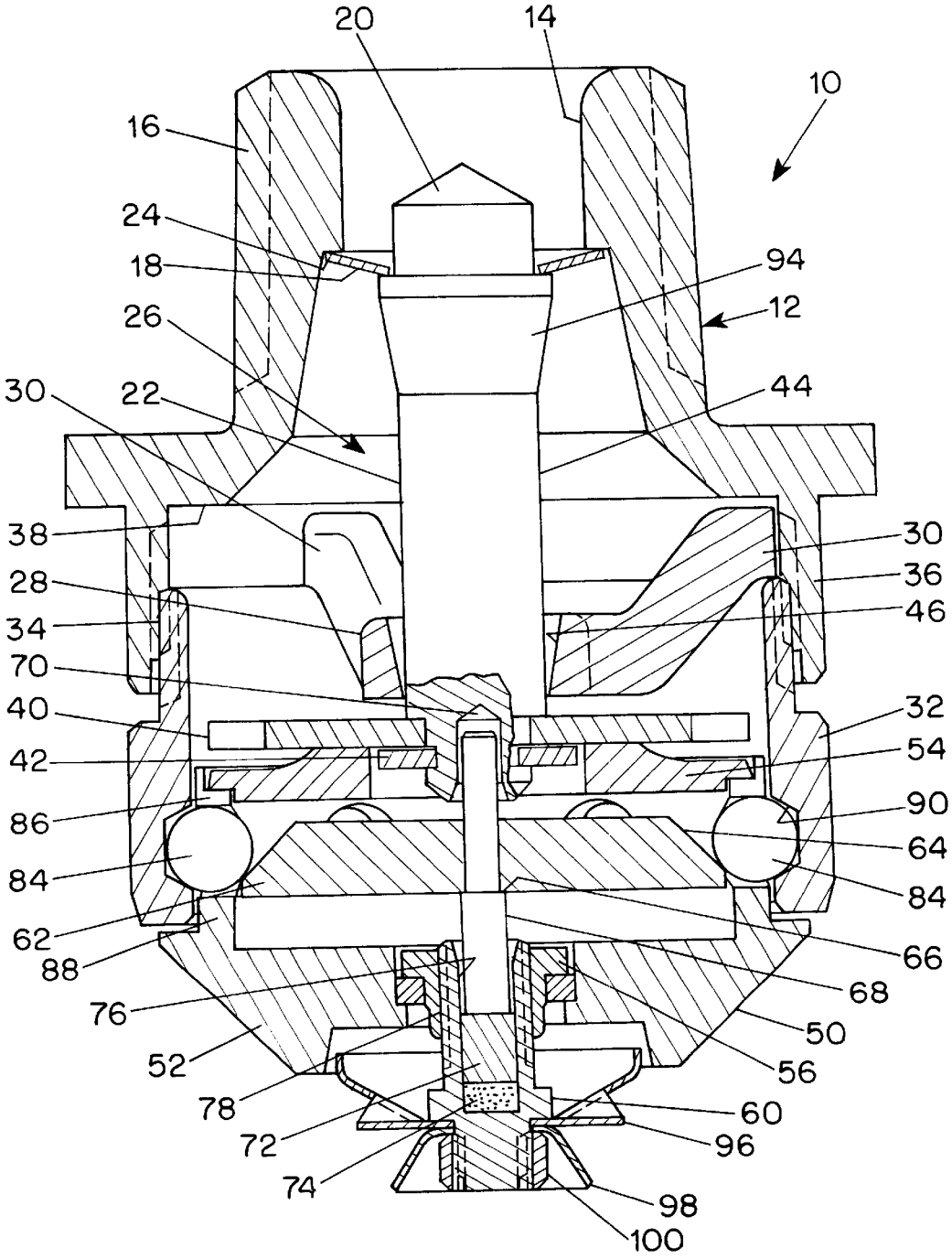
FIG. 1 is a longitudinal sectional view illustrating one representative embodiment of a quick response automatic sprinkler arrangement in accordance with the invention.
Figure 2:
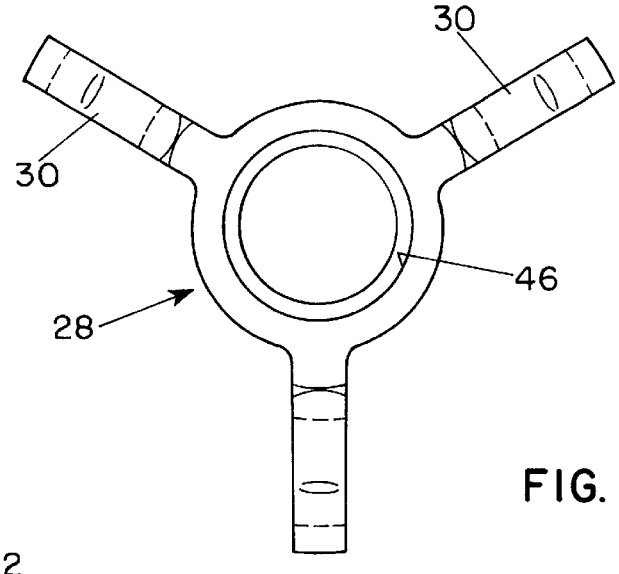
FIG. 2 is an end view of a tripod member arranged to receive a post supporting a deflector in the sprinkler arrangement of FIG. 1.

In the typical embodiment of the invention illustrated in FIGS. 1–7, a sprinkler 10 includes a hollow body 12 which has an internal axial passageway 14 for water and is externally threaded at one end 16 for attachment to a water supply pipe. The axial passage 14 is normally sealed by a spring washer such as a Belleville washer 18 which is supported on the inner end 20 of a central post 22 and has a peripheral surface engaging a shoulder 24 in the passage wall facing toward the outlet end 26 of the passage. The washer 18 is preferably coated with a resin layer such as a polytetrafluoroethylene layer to resist corrosion and provide good sealing engagement with the shoulder 24.

In order to support the post 22 for axial motion with respect to the sprinkler passage 14, a tripod member 28 has three angularly spaced legs 30 which are held captive near the outer end of the sprinkler body 12 by a ring 32 which is threaded into internal threads 34 in a cylindrical projection 36 of the housing so that the legs 30 are fixed in position between the inner edge of the ring 32 and a shoulder 38 surrounding the outlet end 26 of the passage.

At its outer end the central post 22 carries a planar deflector 40 which is held by a retaining ring 42 in a plane perpendicular to the axis of the sprinkler passage. The post 22 has an outer surface 44 which is slidably received in a central tripod opening 46 which has a conical surface.

In order to releasedly retain the central post 22 in its passage-sealing position, a separable valve-retaining assembly 50 is provided. This retaining assembly includes a retaining housing 52 having a cover 54 at its inner end abutting the deflector 40 and a support bushing 56 for a temperature-sensitive device 60 which projects from the outer end of the retaining assembly 50. Within the retainer housing 52 a locking disc 62 has a beveled outer edge surface 64 and is supported on a shoulder 66 of a central locking pin 68 which extends through the locking disc 62 into an axial recess 70 in the central post 22. At its opposite end the locking pin 68 engages a piston 72 which is, in turn, supported by a plug 74 of fusible material at the inner end of an axial passage 76 in a tubular housing 78.

Surrounding the beveled edge surface 64 of the locking disc 62 are a plurality of balls 84 supported in corresponding openings 86 in an annular wall 88 of the retainer housing 52. The outer surfaces of the balls 84 are received in an annular inner groove 90 in the inner surface of the ring 32 and the inner surfaces of the balls engage the surface 64 of the locking disc 62. As a result, the locking disc 62 and the balls 84 lock the retaining housing 52 in position in the ring 32 as long as the plug 74 of fusible material remains solid, but when the fusible material is melted at a selected high ambient temperature, the locking pin 66 and the locking disc 62 move downwardly in the axial passage 76, permitting the balls 84 to move inwardly which, in turn, permits the retaining assembly 50 to be released from the ring 34. The Belleville washer 18 then forces the central post 22 outwardly, ejecting the locking assembly and the water under pressure in the sprinkler passage forces the deflector 40 outwardly in the sprinkler passage until an outwardly inclined conical surface 94 at the inner end of the central post engages the corresponding conical central opening 46 in the tripod 28 so that the central post is firmly held in the axial orientation by the tripod.

Figure 3:
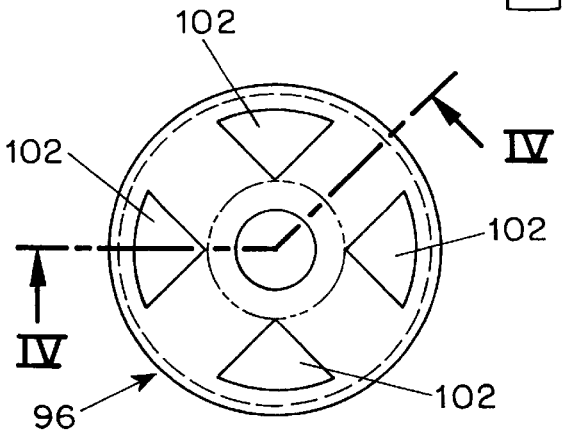
FIGS. 3 and 4 are plan and cross-sectional views, respectively, of a heat collecting cup member for the embodiment of FIG. 1.
Figure 4:
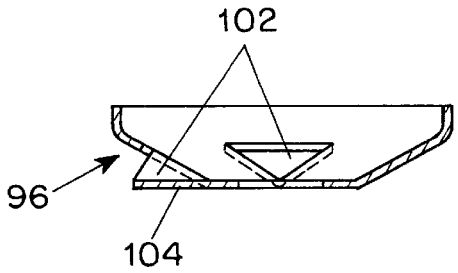
Figure 5:
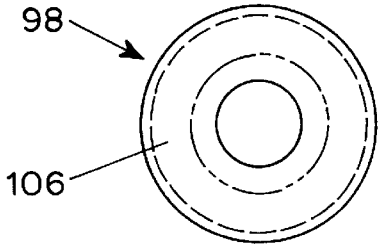
FIGS. 5 and 6 are plan and sectional views, respectively, of a heat collecting dish member for the embodiment of FIG. 1.
Figure 6:
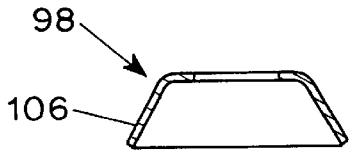

In order to convey heat from the surrounding region to the temperature sensitive device 60 in a rapid and efficient manner, an inwardly open heat collecting dish member 96 and an outwardly open heat collecting cup member 98 are mounted at the outer end of the thermally responsive assembly by a nut 100. As best seen in FIGS. 3 and 4, the heat collecting dish member 96 has four triangular openings 102 from which the metal has been bent downwardly to produce corresponding projecting surfaces 104. The cup member 98, as shown in FIGS. 5 and 6, has a peripheral surface 106 which is inclined outwardly away from the horizontal at an angle of about 60° from the horizontal. Both the cup member and the dish member are made of thin heat conductive materials such as 0.012 inch (0.3 mm) thick brass CDA alloy.

Figure 7:
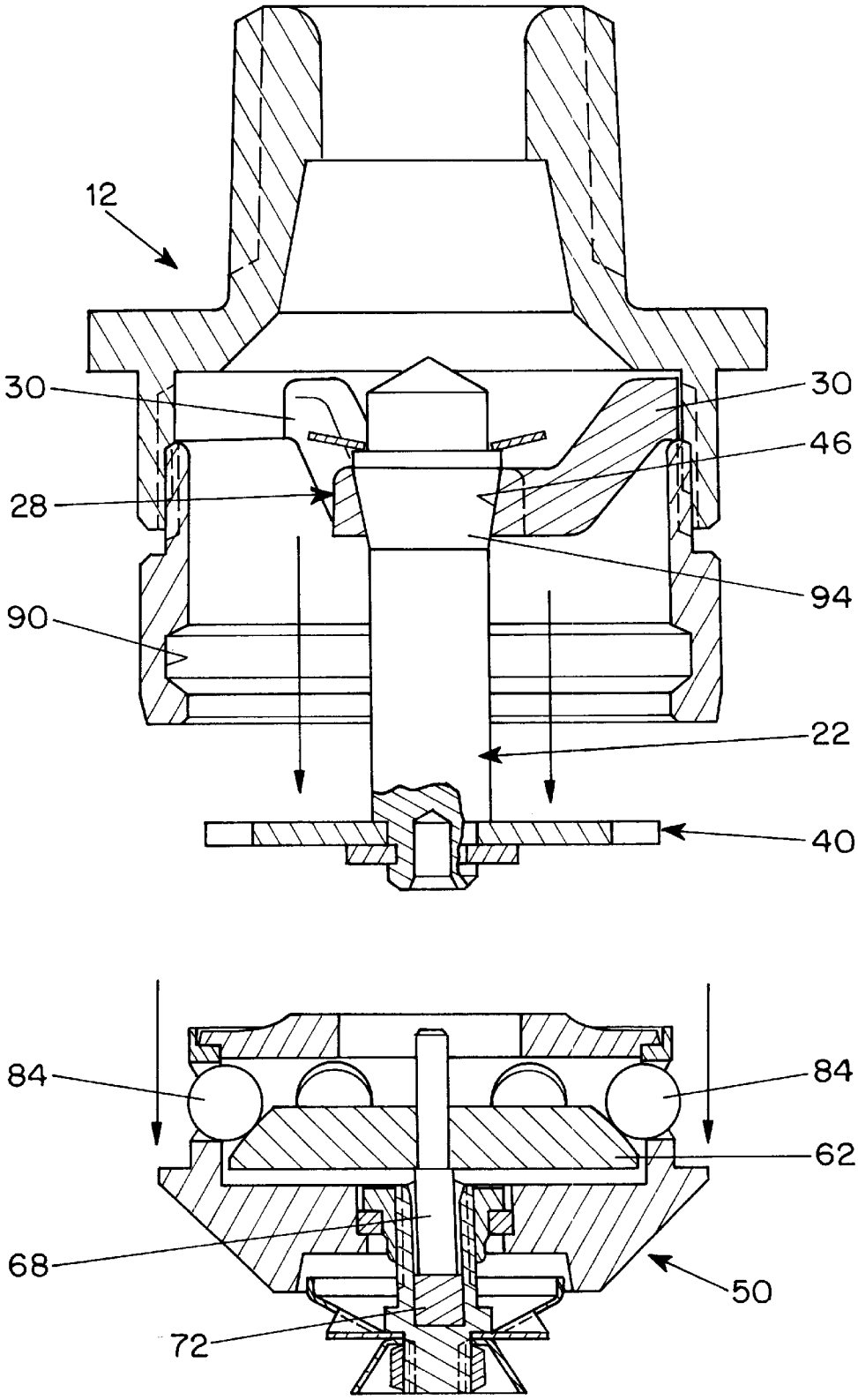
FIG. 7 is a view similar to FIG. 1 illustrating the position of the sprinkler components after activation of the sprinkler.

FIG. 7 illustrates the positions of the various parts of the sprinkler 10 after it has been activating by melting of the fusible plug 74 at a selected elevated temperature. As shown in FIG. 7, the retaining assembly 50 is ejected from the sprinkler body 12 when the locking pin 66 together with the locking disc 62 have moved outwardly from the body 12, permitting the balls 84 to move inwardly into the openings 86 in the annular wall 88 so that they are released from the annular internal groove 90 in the ring 32. As a result the movable assembly including the central post 22 with the deflector 40 moves outwardly from the sprinkler passage so that the deflector is positioned beyond the outer end of the ring 32 and the conical surface 94 of the post 22 is firmly engaged in the conical opening 46 of the tripod 28, permitting water to pass directly to the deflector 40 and be distributed about the region to be protected by the sprinkler.

With a sprinkler arrangement of the type described above and shown in FIGS. 1–7, the size, weight and cost of making a sprinkler is substantially reduced in comparison, for example, to a sprinkler of the type shown in U.S. Pat. No. 4,766,961. In particular, the sprinkler of the present invention has an axial length which is 28% less and a weight which is 44% less than a sprinkler of the type described in that patent and has a manufacturing cost estimated at 30 to 40% less than that of the prior art sprinkler. Moreover the thin metal cup and dish members which transfer heat to the temperature sensitive device 60 are less subject to accidental or deliberate breakage and deformation than the disc shaped fins of the prior art arrangement.

Figure 8:
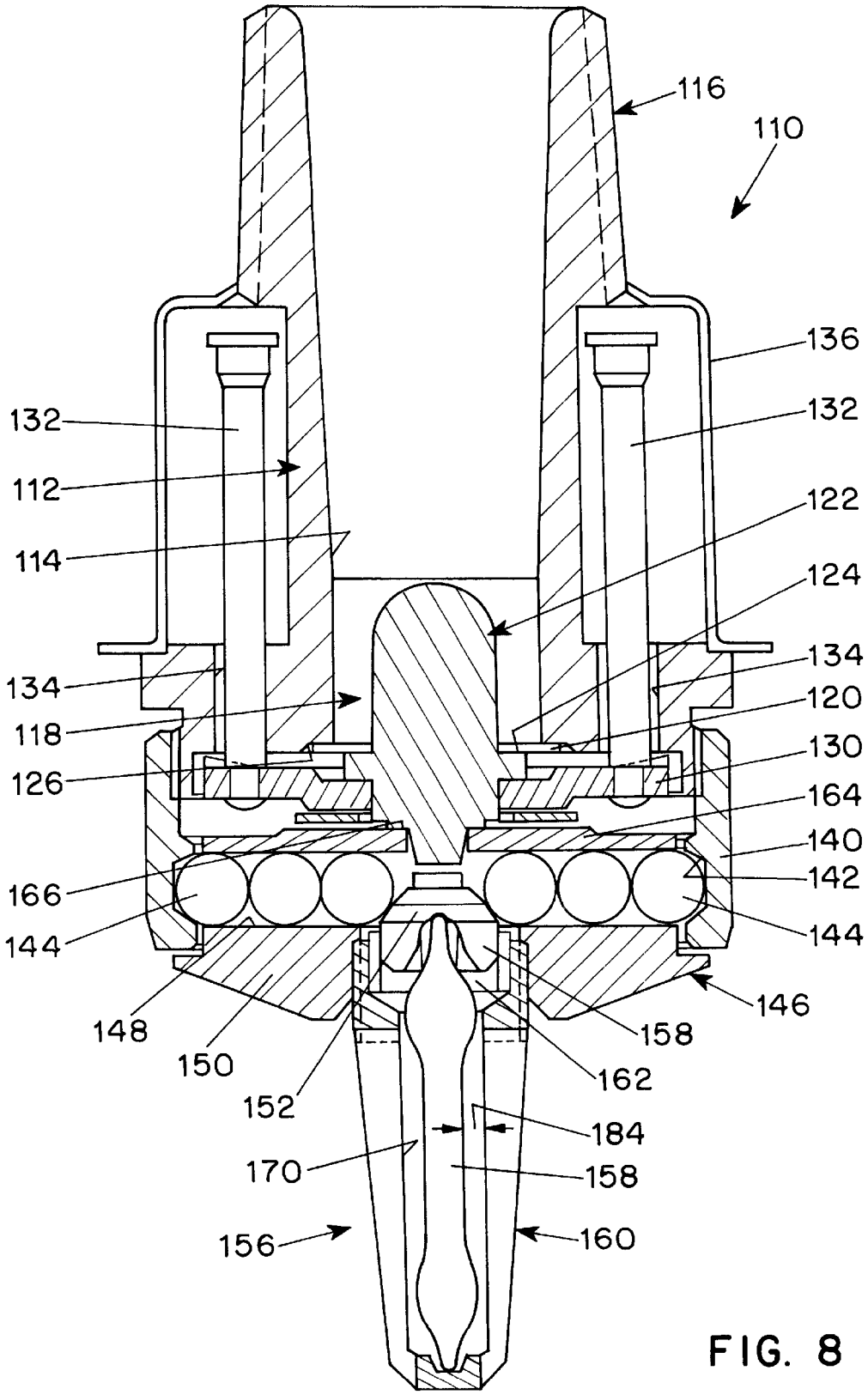
FIG. 8 is a longitudinal sectional view illustrating a second representative embodiment of a sprinkler arrangement in accordance with the invention.
Figure 9:
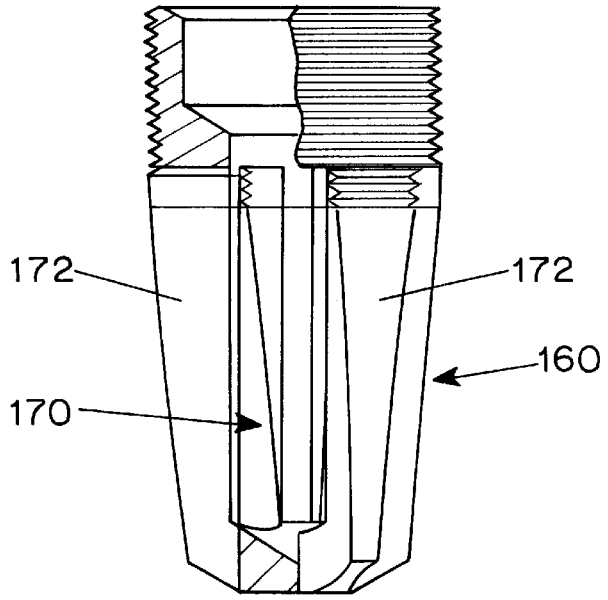
FIG. 9 is an enlarged sectional view, taken on the line IX—IX of FIG. 10, illustrating a bulb cage for the glass bulb in the embodiment of FIG. 8.
Figure 10:
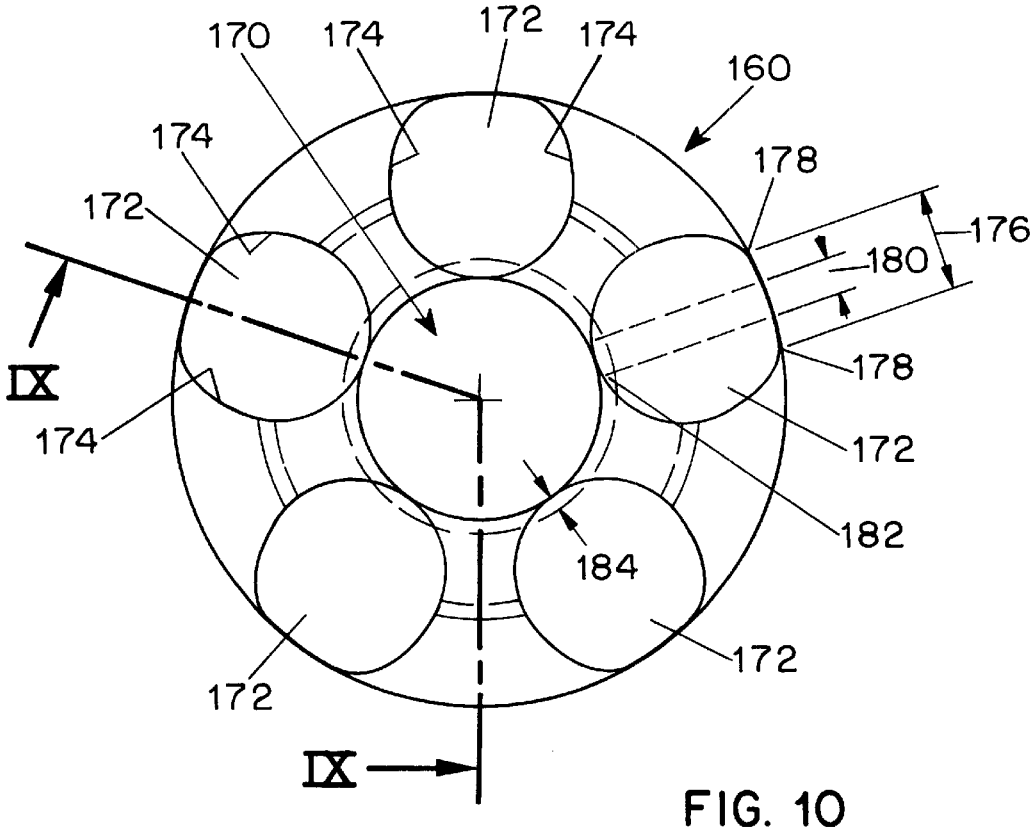
FIG. 10 is an end view of the bulb cage shown in FIG. 9.

A second embodiment of the invention, illustrated in FIGS. 8–10, also provides the advantages of reduced size and weight and eliminates susceptibility to possible damage of heat transfer components in the temperature sensitive device 60 of the first embodiment. In this embodiment, a sprinkler 110 has a sprinkler body 112 containing a central passage 114 and an externally threaded end 116 for attachment to a water supply pipe. The passage 114 is normally sealed at its outer end 118 by a spring washer such as a Belleville washer 120 mounted on a centrally positioned diffuser member 122 extending into the end 118 of the passage 114 in the closed position. The Belleville washer 120 preferably has a coating of a resin material such as polytetrofluoroethylene to assure corrosion resistance and form a good seal between a shoulder 124 of the diffuser on which it is supported and a shoulder 126 in the sprinkler body 112 surrounding the outer end 118 of the passage 114.

A deflector 130 mounted on the outer end of the diffuser 122 is supported for axial sliding motion toward and away from the outer end 118 of the passage by two pins 132 received in corresponding openings 134 in the sprinkler body 112.

A dust cover 136 surrounds the central portion of the sprinkler body 112 enclosing the pins 132 and a collar 140, threadedly mounted at the outer end of the sprinkler body 112, has an internal groove 142 in which the outermost balls 144 of a plurality of linear arrays of such balls are received in order to retain a locking assembly 146 containing the balls in position and the outer end of the sprinkler body. In the unactivated condition of the sprinkler the arrays of balls 144 are urged outwardly in radially extending openings 148 in a support bushing 150 by an inclined outer surface 152 of a central piston 154 which is normally held in the ball-retaining position by a temperature-sensitive device 156. In this embodiment, the temperature sensitive device 156 includes a glass bulb 158 supported in a bulb cage 160 which is threaded into a central opening in the support bushing 150. The piston 154 is slidably guided in a guide sleeve 162 which is made of or coated with a synthetic resin material such as polytetrofluorethylene to assure smooth axial sliding motion of the piston and to avoid the effects of corrosion. The glass bulb 158 is a quick response bulb designed to fragment at a selected high temperature such as 155° F. In order to avoid stress fracture of the bulb, the compressive load applied to the bulb is reduced by the mechanical advantage produced by the inclined surface 152 which engages the balls 144 to urge them outwardly into the groove 142 in the collar 140 as the collar is threaded onto the sprinkler body 112. The inner surface 164 of the locking assembly engages a shoulder 166 at the outer end of the diffuser 122 so that threading of the collar 140 onto the sprinkler body 112 urges the diffuser member 122 inwardly into the passage 114. During assembly, the collar 140 is tightened sufficiently to produce a desired deflection of the Belleville washer 120.

Figure 11A:
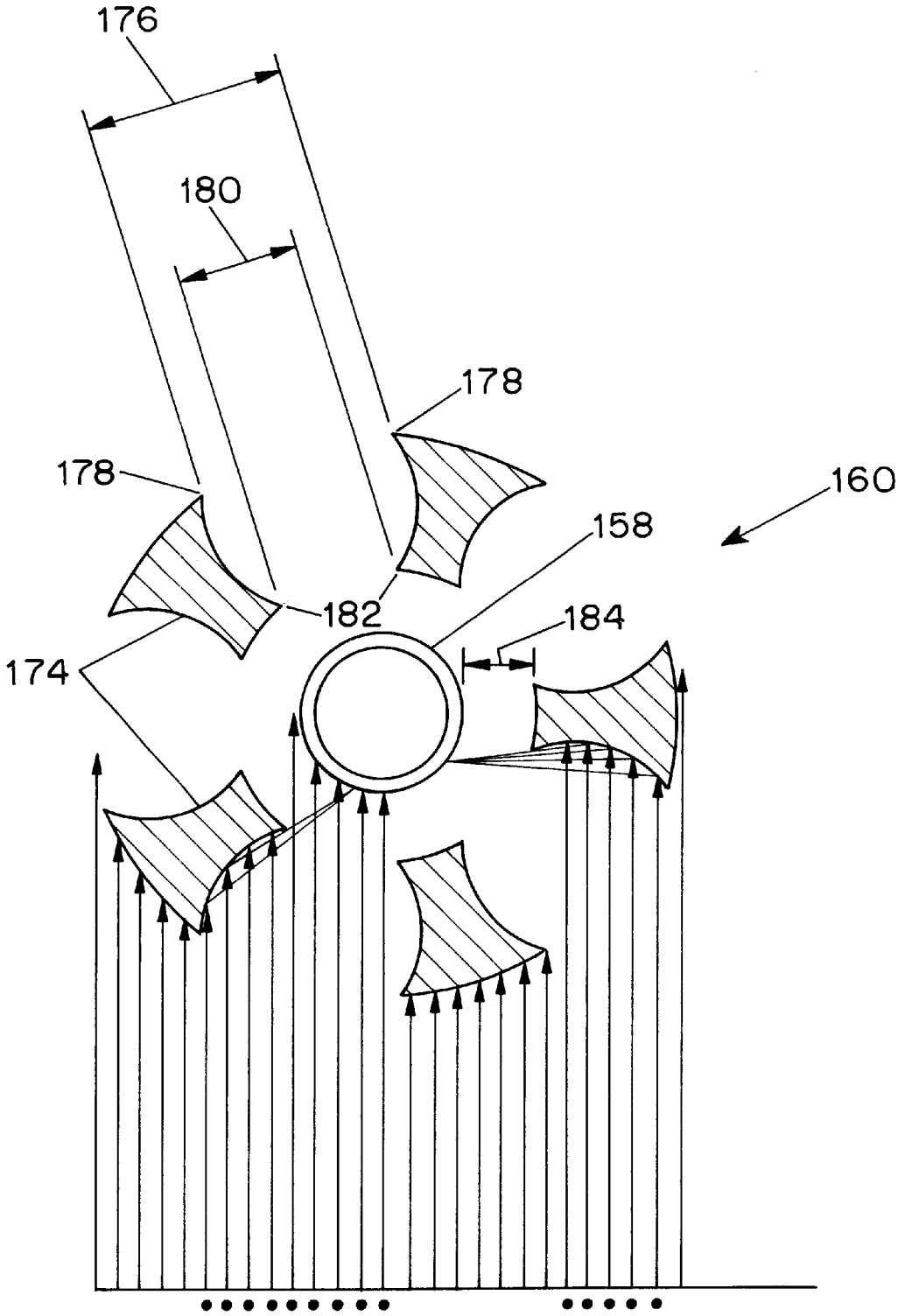
FIGS. 11A, 11B and 11C are schematic diagrams illustrating the flow pattern of hot air impinging on the bulb cage of FIGS. 9 and 10 at various angular orientations.
Figure 11B:
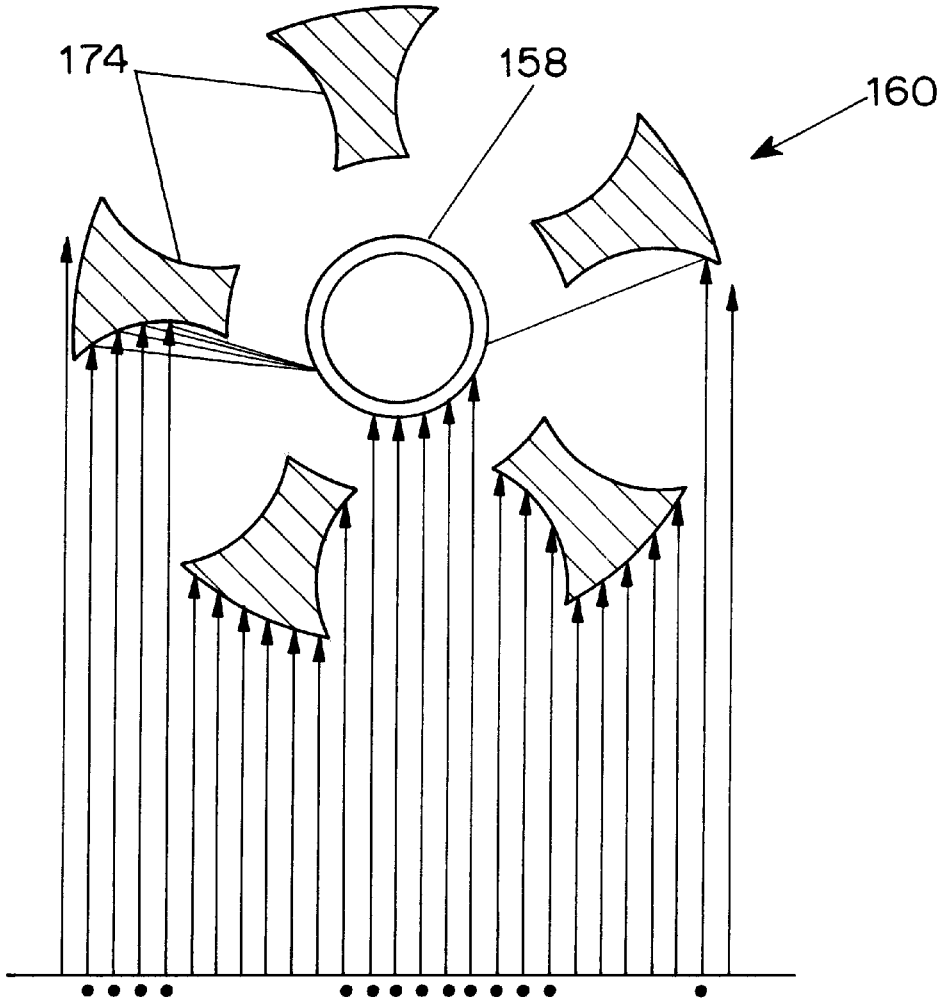
Figure 11C:
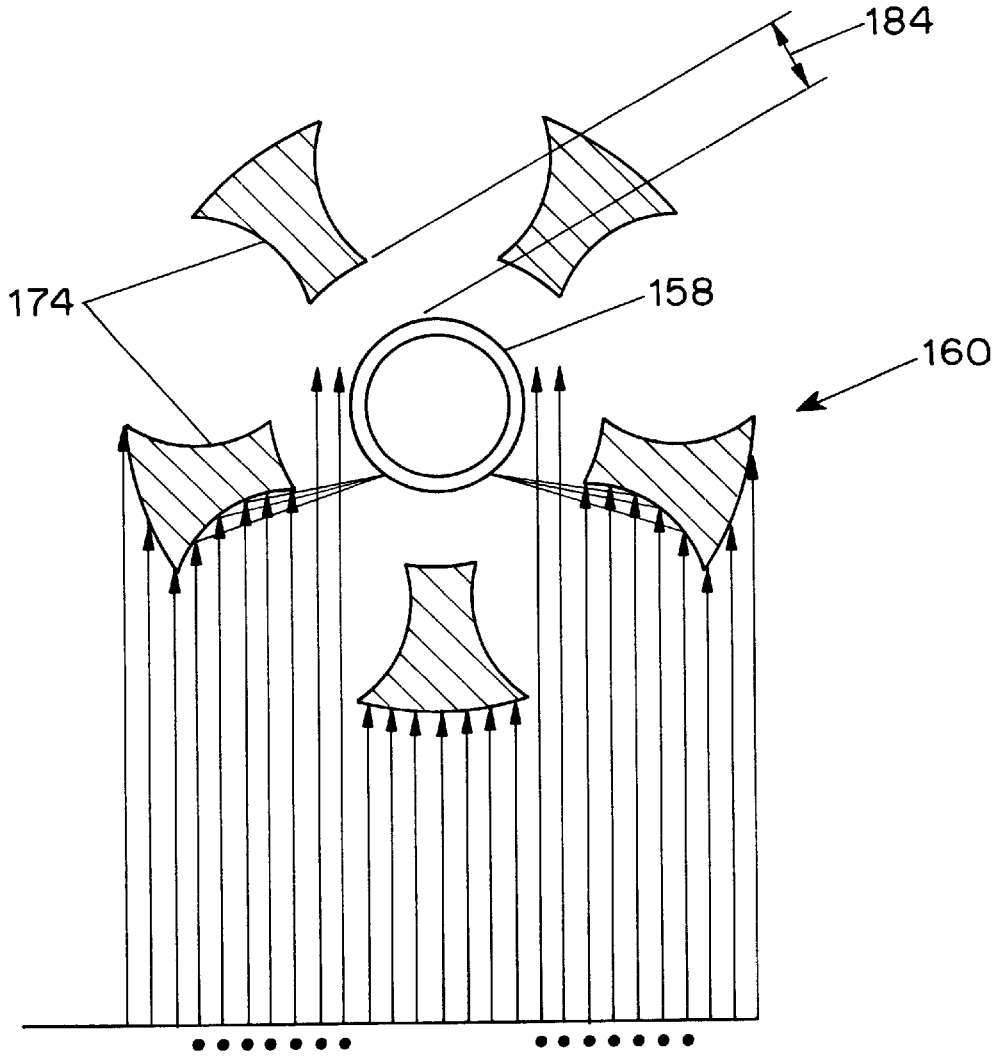

The bulb cage 160 has a central opening 170 in which the bulb is received and, as best seen in FIGS. 9 and 10, the cage has five lateral openings 172 formed by cylindrical cuts in the cage wall extending parallel to the axis of the bulb cage to provide communication between the central opening 170 and the exterior of the bulb cage. As shown in FIG. 10, the resulting side walls 174 of the cylindrical openings 172 have a corresponding arcuate shape and this shape facilitates motion of air moving adjacent to the bulb cage into the interior of the bulb cage to transfer heat to the bulb. Because there are an odd number, such as five, of such openings distributed uniformly around the periphery of the bulb cage, a portion of the air passing in any direction adjacent to the bulb cage is diverted into the central opening 170 by two or more of the walls 174. This is illustrated in FIGS. 11A, 11B and 11C which show how the surfaces 174 direct air inwardly toward the bulb regardless of the angle at which the air approaches the bulb cage. Furthermore, the spacing 176 between the outer edges 178 of each opening 172 is larger than the spacing 180 between inner edges 182 of each of the openings 172 and the spacing 184 between the bulb 158 and the inner surface 170 is smaller than the spacing 180. This arrangement causes the air which flows through one of the openings 172 toward the bulb 158, then around the bulb and out of another opening 172 at the opposite side of the cage to flow more rapidly in the region surrounding the bulb, thereby not only increasing the rate of heat transfer from the air to the bulb but also producing a venturi effect at the intermediate opening 172 past which the air is flowing from one side of the cage to the other, so as to draw air in toward the bulb from the airstream flowing past that opening.

In the schematic illustrations of FIGS. 11A, 11B, and 11C, twenty-seven equally spaced arrows represent a stream of air passing in a direction toward the bulb cage 160 at three different angular orientations spaced by 120°. In each of the illustrated orientations fourteen of the twenty-seven arrows either strike the bulb directly or are intercepted by a concave surface 174 from which they are deflected inwardly toward the bulb. Consequently, at each orientation of the bulb cage, at least 50%, i.e., approximately 52%, of the approaching air stream impinges the bulb directly or after deflection by the concave surfaces. In addition, as discussed above, a proportion of the air passing adjacent to an intervening opening which does not receive air directly is drawn into the cage by the venturi effect. Consequently, a rapid response to impingement of hot gases or air at elevated temperature is provided by this temperature-sensitive arrangement.

Figure 12:
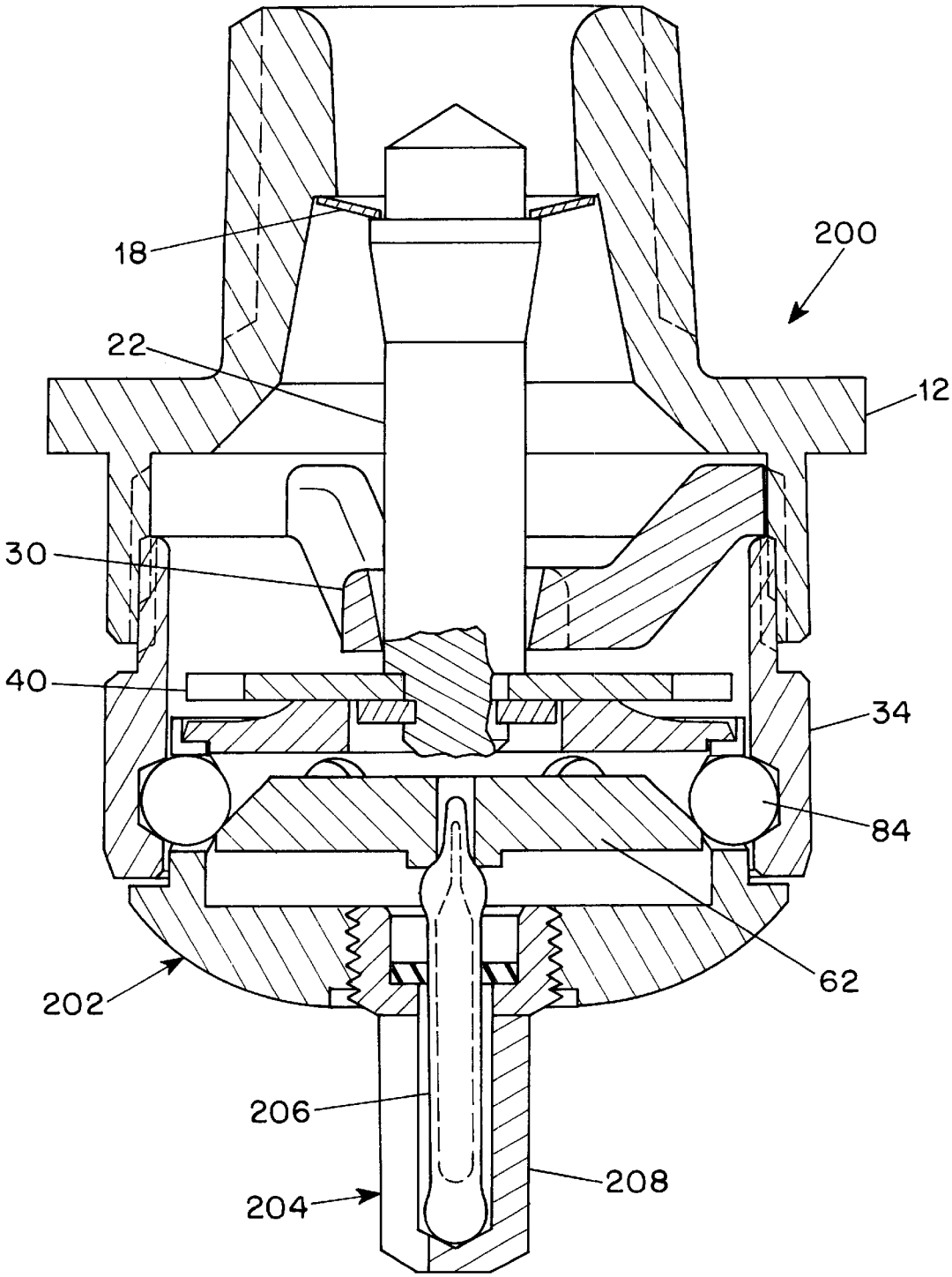
FIG. 12 is a longitudinal sectional view illustrating a third representative embodiment of a sprinkler arrangement according to the invention.

In a third embodiment of the invention a sprinkler 200, illustrated in FIG. 12, is similar to the embodiment of FIGS. 1–7 but has a locking assembly 202 in which a temperature sensitive device 204 includes a glass bulb 206 mounted in a bulb cage 208 of the same type described above as with respect to FIGS. 8–11 in place of the temperature sensitive device using a fusible material described in connection with FIGS. 1–7. This arrangement combines the compact configuration of the sprinkler body and release mechanism with the simple structure of the glass bulb temperature sensitive device.

Figure 13:
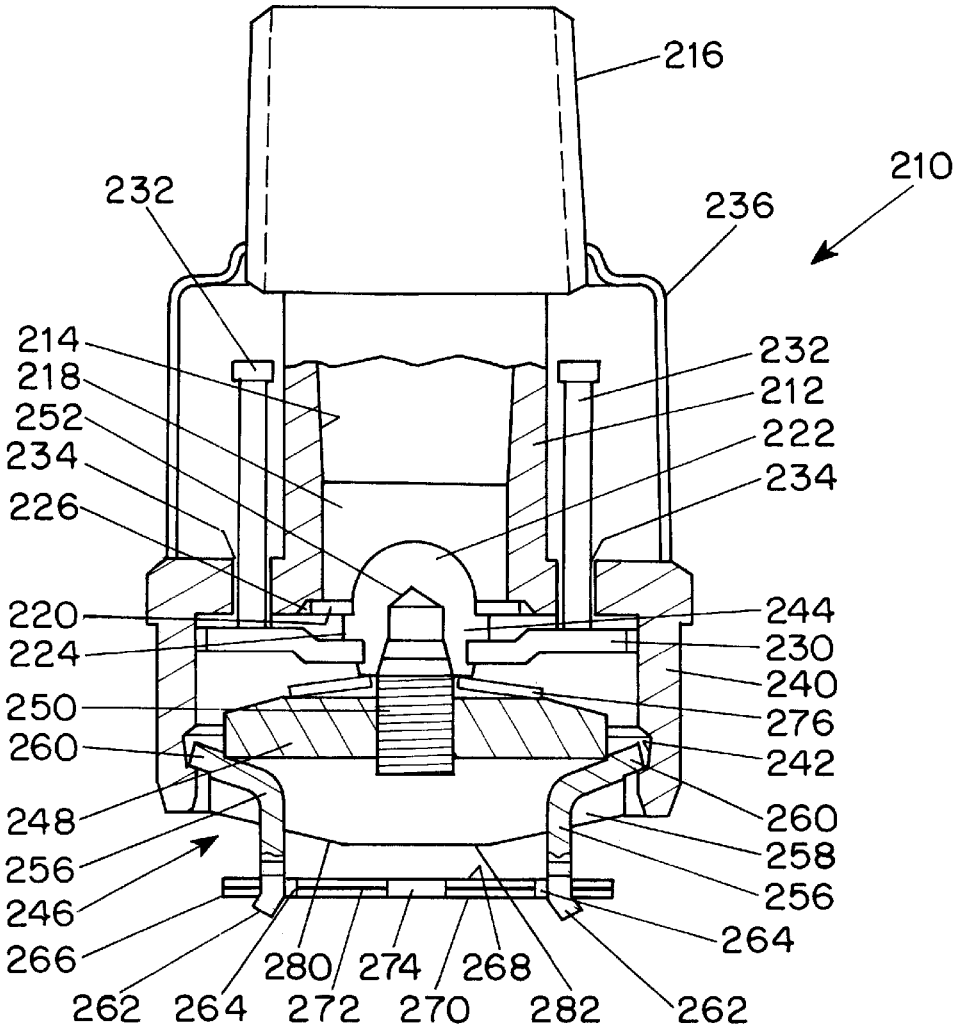
FIG. 13 is a longitudinal sectional view illustrating a fourth embodiment of a sprinkler arrangement according to the invention.
Figure 14:
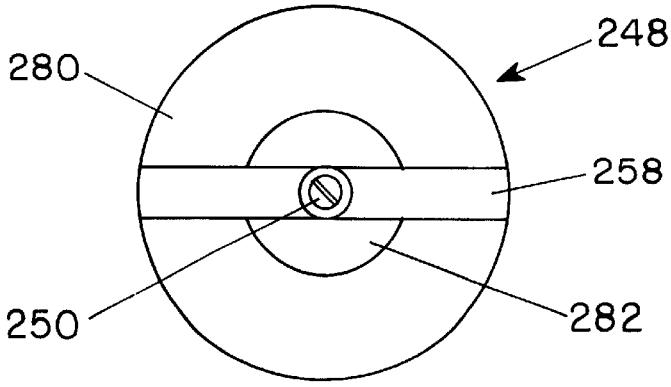
FIG. 14 is a plan view of a locking disc used in the embodiment of FIG. 13.

An additional embodiment of the invention, shown in FIGS. 13 and 14, also provide the advantage of reduced size and weight and uses a rapid response heat sensitive arrangement of established and proved construction. In this embodiment, a sprinkler arrangement 210 has a sprinkler body 212 containing a central passage 214 and an external thread 216 at its inner end for attachment to a water supply. The passage 214 is normally closed at its outer end 218 by a spring washer 220 such as a Belleville washer mounted on a centrally positioned diffuser member 222 projecting into the outer end 218 of the passage 214 in the closed position. The Belleville washer 220 preferably has a coating of a resin material such as a polytetrofluoroethylene to resist corrosion and assure a good seal between a shoulder 224 of the diffuser 222 on which it is seated and a shoulder 226 in the sprinkler body 212 surrounding the outer end 218 of the passage 214. A deflector 230 mounted on the outer end of the diffuser 222 is supported for sliding motion toward and away from the outer end 218 of the passage by two pins 232 received in corresponding openings 234 of the sprinkler body 212 and a dust cover 236 surrounds the central portion of the sprinkler body 212 enclosing the pins 232.

A collar 240 projecting forwardly from the sprinkler body has an internal groove 242 near its outer end and a movable assembly 244 consisting of the deflector 230 and the sealing member 220 is retained in the passage sealing position by a locking assembly 246 which includes a locking disc 248 positioned within the collar 240. The locking disc has an adjustable screw 250 received in a central opening 252 in the outer end of the diffuser 222 and, to retain the locking disc in its illustrated position holding the movable assembly 244 in the sealing position, two levers 256, received a diametrical channel 258 in the outer surface of the locking disc 248, have inner ends 260 engaging the groove 242 and outer ends 262 received in corresponding openings 264 in a temperature sensitive solder link device 266. The solder link device consists of two flat metal plates 268 and 270 held together by a layer 272 of solder which is arranged to melt and release the plates permitting the levers 256 to separate and release the locking disc 248 when the temperature exceeds a selected high level such as 165° F. A central opening 274 in the temperature sensitive device permits access to the adjusting screw 250 after the locking assembly has been installed. A wave spring 276 positioned between the locking disc 248 and the deflector 230 urge the movable assembly in the direction away from the axial passage 214.

Since the locking disc 248 has approximately the same diameter as the deflector 230, it completely fills the opening in the collar 240, thereby concealing the movable assembly 244 until the locking assembly has been released and ejected from the collar at an elevated temperature, thereby permitting the deflector to move outwardly to a position beyond the collar to distribute water emerging from the passage 214.

To expedite actuation of the temperature sensitive device, the locking disc 248 has an annular outer surface portion 280 which is inclined outwardly in the direction from the periphery of the disc to a central surface portion 282 located directly behind the center of the temperature sensitive device 266 both surface portions 280 and 282 being bisected by the channel 258 in which the levers 256 are positioned. As best seen in FIG. 13, the annular surface portion 280 can direct hot gases approaching the sides of the locking disc outwardly toward the rear surface of the temperature sensitive device 266, thereby facilitating rapid actuation of the device.

Although the invention has been described herein with reference to specific embodiments, many modifications and variations therein will readily occur to those skilled in the art. Accordingly, all such variations and modifications are included within the intended scope of the invention.

I claim:

1. A quick response sprinkler arrangement comprising:

a sprinkler body with an axial passage for fire extinguishing fluid having an inlet end and an outlet end;

an axially movable assembly movable between a sealing position and an open position which includes a deflector extending transversely to the axis of the sprinkler and a spring sealing member engaging a seat on the sprinkler body and a seat on the axially movable assembly for sealing the axial passage in the sealing position and for urging the axially movable assembly away from the sealing position;

a support structure at the outlet end of the axial passage having a cylindrical opening containing the deflector in the sealing position of the axially movable assembly;

a locking arrangement adjacent to the deflector and normally held in a locking position within the cylindrical opening and having a configuration arranged to conceal the deflector and retain the axially movable assembly in the sealing position; and a temperature sensitive device axially disposed outwardly from the cylindrical opening and from the support structure and the locking arrangement and normally retaining the locking arrangement in the locking position and actuable in response to an elevated temperature condition to release the locking assembly from its locking position and permit the axially movable assembly to move from the sealing position to the open position, thereby permitting fire extinguishing fluid to emerge from the outer end of the passage and be distributed by the deflector.

2. A quick response sprinkler arrangement according to claim 1 wherein the support structure includes a tripod member having a central opening for slidably guiding the axially movable assembly.

3. A quick response sprinkler arrangement according to claim 2 wherein the central opening has a conical inner surface and the axially movable assembly has a conical outer surface engageable with the conical inner surface in the open position.

4. A quick response sprinkler arrangement according to claim 1 wherein the sealing member is a spring washer.

5. A quick response sprinkler arrangement according to claim 4 wherein the spring washer has a coating of resin material.

6. A quick response sprinkler arrangement according to claim 1 wherein the temperature sensitive device includes a locking pin supported by a fusible material in a position to retain the locking assembly in the locking position and movable to release the locking assembly from the locking position upon fusing of the fusible material.

7. A quick response sprinkler arrangement according to claim 1 wherein the temperature sensitive device includes a cup shaped metal member open in the outward direction of the passage to convey heat to a thermally responsive element.

8. A quick response sprinkler arrangement according to claim 1 wherein the temperature sensitive device includes a dish shaped metal member open in the direction toward the passage and arranged to convey heat to a thermally responsive element.

9. A quick response sprinkler arrangement according to claim 1 wherein the temperature sensitive device includes a glass bulb supported in a bulb cage.

10. A quick response sprinkler arrangement according to claim 9 wherein the locking assembly includes an axially slidable piston having a beveled surface and a plurality of balls normally retained in a radially outward position by the beveled surface to hold the locking arrangement in its locking position, the piston being normally supported by the glass bulb in a locking position to retain the plurality of balls in the radially outward position and being movable out of the locking position upon fracture of the glass bulb at an elevated temperature.

11. A quick response sprinkler arrangement according to claim 10 including a guide sleeve having a surface containing resin material for guiding sliding motion of the piston.

12. A quick response sprinkler arrangement according to claim 9 wherein the bulb cage is formed with a plurality of peripheral openings permitting air to pass into the interior of the cage.

13. A quick response sprinkler arrangement according to claim 12 wherein the number of peripheral openings is an odd number.

14. A quick response sprinkler arrangement according to claim 13 wherein the number of peripheral openings is five.

15. A quick response sprinkler arrangement according to claim 12 wherein each of the plurality of openings extends parallel to the axis of the sprinkler arrangement and has concave side surfaces arranged to direct air flowing transverse to the opening into the interior of the cage.

16. A quick response sprinkler arrangement according to claim 12 wherein each opening has a width at its outer end that is greater than the width of the inner end to produce a venturi effect.

17. A quick response sprinkler arrangement according to claim 12 wherein the distance between the glass bulb and the inner surface of the bulb cage is less than the width of each of the openings at its inner end.

18. A quick response sprinkler arrangement according to claim 12 wherein the plurality of openings are arranged so that at least about 50% of an air stream passing toward the bulb cage at any angular orientation about the axis of the sprinkler will be directed into the interior of the bulb cage.

19. A quick response sprinkler arrangement according to claim 1 wherein the support structure comprises a collar having an internal recess and the locking arrangement includes a plurality of elements normally engaging the internal recess and normally retained therein by the temperature sensitive device.

20. A quick response sprinkler arrangement according to claim 1 including a spring member disposed between the deflector and the locking arrangement to urge the locking arrangement away from the deflector.

21. A quick response sprinkler arrangement according to claim 1 wherein the locking arrangement includes a member having a generally cylindrical shape disposed adjacent to and substantially covering the deflector.

22. A quick response sprinkler arrangement comprising:

a sprinkler body having an axial passage for fire extinguishing fluid with an inlet end and an outlet end;

an axially movable assembly movable between a sealing position and an open position which includes a deflector extending transversely to the axis of the sprinkler and a sealing member for sealing the axial passage;

a locking arrangement normally held in a locking position to retain the axially movable assembly in the sealing position;

a temperature sensitive device normally retaining the locking arrangement in the locking position and including a thermally responsive element disposed axially outwardly of the deflector in the sealing position of the axially movable assembly and having an outer surface facing away from the sprinkler body and an inner surface facing toward the sprinkler body; and a locking disc forming a part of the locking arrangement and disposed between the deflector and the temperature sensitive device and having an outer surface facing the thermally responsive element with a peripheral portion inclined toward the rear surface of the thermally responsive element to direct air toward the rear surface of the thermally responsive element.

23. A quick response sprinkler arrangement according to claim 22 wherein the thermally responsive element is a solder link containing two plates joined by a solder layer and wherein the locking arrangement includes two lever members each having one end retained in fixed position by the solder link and another end engaging the locking disc and received in a recess in the sprinkler body to hold the locking disc in position.

24. A quick response sprinkler arrangement according to claim 23 including an adjustable screw in the locking disc and an aperture in the solder link to provide access to the adjusted screw.

25. A quick response sprinkler arrangement according to claim 23 wherein the locking disc has a diametrical channel in the outer surface in which the lever members are engaged.

26. A quick response sprinkler arrangement according to claim 22 wherein the axially movable assembly includes a diffuser member supporting the sealing member and the deflector and extending into the axial passage in the sealing position.

* * * * *